US006838173B2

(12) United States Patent
Naruse et al.

(10) Patent No.: US 6,838,173 B2
(45) Date of Patent: Jan. 4, 2005

(54) POLYESTER FIBER AND PRODUCTION METHOD OF POLYESTER COMPOSITION

(75) Inventors: Yoshihiro Naruse, Mishima (JP); Toshihiro Sasaki, Susono (JP); Yoshitaka Matsumura, Mishima (JP)

(73) Assignee: Toray Industries, Inc., Tokyo (JP)

( * ) Notice: Subject to any disclaimer, the term of this patent is extended or adjusted under 35 U.S.C. 154(b) by 418 days.

(21) Appl. No.: 10/030,817

(22) PCT Filed: May 21, 2001

(86) PCT No.: PCT/JP01/04200

§ 371 (c)(1),
(2), (4) Date: Jan. 14, 2002

(87) PCT Pub. No.: WO01/90455

PCT Pub. Date: Nov. 29, 2001

(65) Prior Publication Data

US 2003/0088012 A1 May 8, 2003

(30) Foreign Application Priority Data

May 22, 2000 (JP) ..... 2000-149449
Jun. 7, 2000 (JP) ..... 2000-170371

(51) Int. Cl.[7] ..... D02G 3/02; C08K 3/34

(52) U.S. Cl. ..... 428/372; 428/372; 524/493

(58) Field of Search ..... 428/372, 373; 524/493

(56) References Cited

U.S. PATENT DOCUMENTS 4,699,627 A * 10/1987 Bailey ..... 8/602
5,207,959 A * 5/1993 Antikow et al. ..... 264/103

FOREIGN PATENT DOCUMENTS

| | | |
|---|---|---|
| JP | 63-312345 | * 12/1988 |
| JP | 1-314723 | * 12/1989 |
| JP | 6-33317 | * 2/1994 |
| JP | 8-113827 | * 7/1996 |

* cited by examiner

*Primary Examiner*—Tae H. Yoon
(74) *Attorney, Agent, or Firm*—Kubovcik & Kubovcik

(57) ABSTRACT

A polyester fiber comprises a hygroscopic polyester composition which contains 1 to 20 percent by weight of hygroscopic silica-based inorganic particles in which the average diameter, the specific surface area, the micropore volume, and the hygroscopic parameter ΔMR are within specified ranges. This hygroscopic fiber is suitable for clothes which require comfortableness.

20 Claims, 1 Drawing Sheet

POLYESTER FIBER AND PRODUCTION METHOD OF POLYESTER COMPOSITION

BACKGROUND OF THE INVENTION

1. Field of the Invention

The present invention relates to a polyester fiber containing silica-based inorganic particles and a method for making a polyester composition. The polyester fiber of the present invention exhibits high hygroscopicity and is suitable for comfortable materials, such as underwear, sportswear, and lining, in the form of woven and knitted fabrics. Herein, the term "comfortable material" means a material requires comfortableness when the material is used in high-temperature and high-humidity environments.

2. Description of the Related Art

Polyesters, such as polyethylene terephthalate (hereinafter, referred to as PET), exhibit excellent physical and chemical properties, and have been widely used as fibers, films, and molded articles. However, PET is hydrophobic and less hygroscopic. When being used in clothes, PET causes sweaty in highly humid environments and generates static electricity. Thus, PET is not a comfortable material as clothes. When it is used as resins and films, electrostatic charge due to low hygroscopicity would cause problems.

In order to solve these problems, methods for copolymerizing or adding hygroscopic compounds to polyesters have been proposed. For example, copolymerization with a diol having oxyalkylene glycol side chains and copolymerization with a dicarboxylic acid containing metal sulfonate are disclosed. These methods for copolymerizing the hygroscopic components, however, cause decreases in mechanical strength and weather resistance.

In addition to the above modification methods of polyesters, methods for bonding hygroscopic compounds to polyester fibers have been proposed. For example, acrylic acid or methacrylic acid is graft-polymerized to polyester fibers and these carboxyl groups are allowed to react with alkali metals to improve hygroscopicity. Hygroscopic compounds bonded to the fiber surface cause generation of slime, a decrease in strength over time, and a decrease in weather resistance.

In order to solve these problems, core-sheath bicomponent fibers have been proposed in which cores of highly hygroscopic resins are covered with polyester sheaths. In the core-sheath bicomponent fibers, however, the core hygroscopic resins are swollen with water during hot-water treatments, such as scouring and dyeing, resulting in cracking on the fiber surface (sheath cracking), effluence of the hygroscopic resins to the exterior, and a decrease in textile quality due to insufficient color fastness.

In order to solve these problems, various methods using hygroscopic inorganic particles instead of the hygroscopic organic compounds and resins have been proposed. When the hygroscopic inorganic particles are contained in general polyesters, active groups of the hygroscopic inorganic particles are embedded in the polymers. Thus, the polyesters do not exhibit sufficient hygroscopicity. Japanese Unexamined Patent Application Publication No. 8-113827 discloses a fiber in which a polyether ester is used as a base polymer instead of polyester and silica gel microparticles are compounded. In this method, some hygroscopicity is imparted to the fiber due to slight hygroscopicity of the polyether ester. However, the polyether ester base polymer has inferior mechanical strength compared with polyesters.

SUMMARY OF THE INVENTION

It is an object of the present invention to provide a polyester fiber having high hygroscopicity with maintaining its original properties.

It is another object of the present invention to provide a method for making a polyester composition.

The present inventors have discovered that the polyester fiber exhibits sufficient hygroscopicity without deterioration of original properties thereof when silica-based inorganic particles are compounded into polyester so as to satisfy the following conditions.

That is, the present invention is characterized by a polyester fiber having a hygroscopic parameter ΔMR of 1% or more containing 1 to 20 percent by weight of silica-based inorganic particles, wherein the silica-based inorganic particles satisfy the following conditions (A) to (C):

(A) the micropore volume is 0.4 ml/g or more, and the following relationship is satisfied:

$$100 \leqq S/V < 1{,}500$$

wherein S means the specific surface area S, in $m^2/g$, of the inorganic particles;

(B) the average particle diameter D is in the range of 0.01 to 10 $\mu$m; and (C) the hygroscopic parameter ΔMR is 7% or more.

The synthetic fiber of the present invention has adequate hygroscopicity and is a comfortable material as clothes. This fiber also exhibits clear-cut texture, high color fastness, and high light resistance. This synthetic fiber is suitable for underwear, shirts, blouses, inner wear, sports wear, slacks, outer wear, backing cloth, curtains, wall paper, and night clothes, such as bed sheets, quilt covers, and filling cotton.

BRIEF DESCRIPTION OF THE DRAWINGS

FIGURE is a schematic view of a silica-based inorganic particle used in the present invention for illustrating the minor axis (1) and the major axis (2).

DESCRIPTION OF THE PREFERRED EMBODIMENTS

Figure 1:
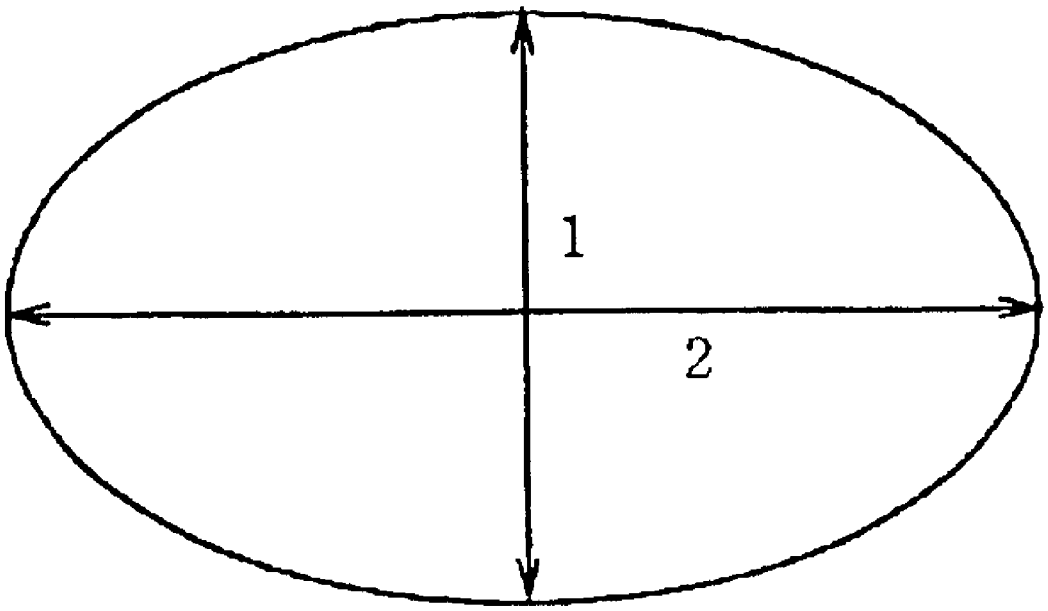

The embodiments of the present invention will now be described.

The silica-based inorganic particles used in the present invention contain, but are not limited to, 50% or more $SiO_2$. Examples of the silica-based inorganic particles include white carbon, silica sol, silica gel, and silica-alumina composite particles which are prepared by dry processes and wet processes. Silica-based inorganic particles prepared by wet processes are preferred because the particles have desired micropore volumes and average particle diameters which impart sufficient hygroscopicity to the polyester. In particular, silica-based inorganic particles prepared by a wet process and containing 95% or more $SiO_2$ is preferable.

The polyester fiber of the present invention contains 1 to 20 percent by weight of silica-based inorganic particles. Content less than 1 percent by weight does not impart sufficient hygroscopicity to the polyester fiber, whereas a content exceeding 20 percent by weight inhibits processability due to noticeably increased melt viscosity of the polymer. The content of the silica-based inorganic particles is more preferably in the range of 3 to 15 percent by weight and most preferably in the range of 5 to 15 percent by weight.

The polyester fiber of the present invention has a hygroscopic parameter ΔMR of 1% or more, preferably 2% or more, and most preferably 2.5% or more in order to achieve comfortableness in wear. Here, hygroscopic parameter ΔMR is represented by MR2-MR1 wherein MR2 means a moisture absorption rate (%) at 30° C. and 90% RH and MR1 means a moisture absorption rate (%) at 20° C. and 65% RH. The ΔMR value is a driving force for achieving comfortableness by releasing the moisture in clothes in wear to the exterior. Here, the environments in the clothes during slight to medium works or movements are represented by 30° C. and 90% RH, and the environments of ambient air are represented by 20° C. and 65% RH. Thus, the ΔMR value means the difference between these environments. In the present invention, the ΔMR value is used as a measurement for evaluating the hygroscopicity. A higher ΔMR value means higher moisture absorption/desorption ability which corresponds to satisfactory comfortableness in wear. The upper limit of the hygroscopic parameter ΔMR is about 20% in practical view, but is not critical.

The silica-based inorganic particles of the present invention have a micropore volume V of 0.4 ml/g or more. A micropore volume less than 0.4 ml/g results in insufficient moisture absorption/desorption. The micropore volume V is more preferably 0.7 ml/g or more and most preferably 1.0 ml/g or more. The upper limit is, but is not limited to, about 5.0 ml/g.

In order to achieve higher hygroscopicity of the silica-based inorganic particles, it is preferable that the micropore volume V (ml/g) and the specific surface area S ($m^2/g$) satisfy the following relationship:

$$100 \leqq S/V < 1{,}500 \ (m^2/ml)$$

The S/V ratio is more preferably in the range of 200 to 1,000 and most preferably in the range of 300 to 800 in view of higher hygroscopicity. An S/V ratio less than 100 does not result in satisfactory hygroscopicity in high-humid environments. An S/V ratio exceeding 1,500 results in excessively high hygroscopicity.

The silica-based inorganic particles used in the present invention have an average particle diameter of 0.01 to 10 μm in which the average particle diameter means a volume average particle diameter. An average particle diameter less than 0.01 μm causes vigorous increasing melt viscosity during polymerizing and compounding, and a resin with a high degree of polymerization is not obtained. An average particle diameter exceeding 10 μm causes a rapid increase in filter pressure. Moreover, such coarse particles cause yarn breakage during a spinning process. The average particle diameter is more preferably in the range of 0.1 to 5 μm and most preferably in the range of 0.2 to 2 μm.

The hygroscopic parameter ΔMR of the silica-based inorganic particles is preferably 7% or more, more preferably 20% or more, and most preferably 30% or more. The upper limit is about 150%, but is not critical. A ΔMR value within the above range imparts desirable hygroscopic ability to the polyester fiber.

It is preferable that the number of the silanol groups per the total surface area of the particles be $2/nm^2$ or more in view of hygroscopicity. At smaller silanol content, the polyester fiber is less hygroscopic. More preferably, the number of the silanol group is $5/nm^2$ or more.

In the present invention, preferably, the diethylene glycol (hereinafter referred to as DEG) content in polyester constituting the polyester fiber is 2 percent by weight or less, and the carboxyl (hereinafter referred to as COOH) end group is in the range of 10 to 50 equivalent/ton. Excess DEG content causes decreased hygroscopicity. Probably, a large DEG content increases the soft segment fraction in the polyester fiber and the soft segments cover active groups on the surfaces of the silica-based inorganic particles, although the mechanism is not understood fully. More preferably, the DEG content is 1 percent by weight or less.

The hygroscopicity tends to increase as the COOH end group content increases. However, excess amounts of COOH end groups facilitate pyrolytic reaction of the polyester which is disadvantageous for mechanical strength of the fiber. More preferably, the COOH end group content is in the range of 20 to 30 equivalent/ton.

In the polyester fiber of the present invention, the coating weight of the polyester (hereinafter, polyester coating weight) is 0.3 g or less per one gram of silica-based inorganic particles. A method for determining the polyester coating weight will be described below. A large coating weight causes blocking the active groups of the silica-based inorganic particles and thus deterioration of hygroscopicity. More preferably, the polyester coating weight is 0.1 g or less per one gram of silica-based inorganic particles.

It is preferable that the polyester fiber of the present invention is subjected to a hydrothermal treatment. Here, the hydrothermal treatment represents bringing the fiber into contact with hot water or vapor, and specifically represents a treatment at a temperature of 80° C. or more under a pressure of 1 atm or more for 30 minutes or more. This treatment may be performed by an exclusive step. Alternatively, this treatment may be performed in a dyeing step or an alkali weight reduction step under predetermined conditions in the production process of the polyester fiber. Such a hydrothermal treatment sufficiently enhances the hygroscopicity of the silica-based inorganic particles in the polyester fiber.

In the polyester fiber of the present invention, the content of particles having a diameter of 4 μm or more in the silica-based inorganic particles is preferably 5% or less. If particles having a diameter of 4 μm or more are contained in an amount exceeding 5%, filaments and yarn frequently break during a spinning process. More preferably, this content is 4% or less.

Preferably, the polyester fiber of the present invention is a conjugated fiber. Examples of conjugated fibers include core-sheath types, matrix types, and mutlilayer types. Core-sheath types are more preferable because the fibers can pass through the production line with high reliability. The hygroscopic silica-based inorganic particles may be compounded in the core and/or sheath. It is preferable that large amounts of particles be compounded in the core to prevent abrasion of guides in the fiber production line. It is most preferable that the particles be compounded only in the core in the core-sheath structure.

The polyester fiber of the present invention is particularly suitable for garments, although this is also useful as industrial materials. More preferably, the polyester fiber is used as conductive materials such as underwear, sportswear, and lining, in the form of woven and knitted fabrics.

Preferably, the polyester constituting the polyester fiber of the present invention contains 80 molar percent or more of alkylene terephthalate repeating units in view of mechanical strength. Preferable examples of the alkylene terephthalate repeating units are polyethylene terephthalate, polybutylene terephthalate, and polypropylene terephthalate. Among these, polyesters containing ethylene terephthalate repeating units are preferable because of high mechanical strength and weather resistance.

The polyester primarily containing ethylene terephthalate repeating units may further contain a tertiary component as long as the object of the present invention is achieved. Examples of tertiary components include aromatic, aliphatic, and alicyclic dicarboxylic acids, such as isophthalic acid, 2,6-naphthalenedicarboxylic acid, diphenyldicarboxylic acid, adipic acid, sebacic acid, and 1,4-cyclohexanedicarboxylic acid; and derivatives thereof. Examples of diols include aromatic, aliphatic, and alicyclic diols, such as propylene glycol, tetramethylene glycol, 1,4-cyclohexanedimethanol, diethylene glycol, neopentyl glycol, polyalkylene glycol, bisphenol A, and bisphenol S.

The polyester fiber of the present invention may contain pigments, such as titanium oxide and carbon black, surfactants such as alkylbenzenesulfonate salts, antioxidants, antitarnish agents, weatherproofers, antistatic agents, and micropore-forming agents, as long as the object of the present invention is achieved.

The ratio d90/d10 representing the particle size distribution of the silica-based inorganic particles contained in the polyester fiber of the present invention is preferably 2.0 or less. Here, d10 and d90 are a 10%-volume accumulated-particle diameter and a 90%-volume-accumulated particle diameter, respectively, when the diameter distribution of the particles is plotted wherein the abscissa is the diameter and the ordinate is the accumulated volume. When the d90/d10 exceeds 2.0, the polymer significantly increases melt viscosity during polymerization of the polyester containing the silica-based inorganic particles, inhibiting a high degree of polymerization. Thus, the resulting fiber exhibits poor mechanical strength. Preferably, the ratio d90/d10 is 1.9 or less.

The aspect ratio of the silica-based inorganic particles contained in the polyester fiber of the present invention is preferably in the range of 1.0 to 1.5. Here, the aspect ratio means the ratio of the length in the major axis to that in the minor axis. In the above range, the particles are substantially spherical and are highly dispersed, resulting in satisfactory hygroscopicity. Preferably, the aspect ratio is in the range of 1.0 to 1.2.

In the polyester composition constituting the polyester fiber of the present invention and containing the silica-based inorganic particles, the silica-based inorganic particles may be added by any method, for example, may be added in any step of the polyester polymerization process or may be compounded into a polyester which has been preliminarily polymerized by kneading. Examples of methods for compounding the particles are (1) a melt mixing method for compounding the silica-based inorganic particles and the polyester in a conventional uniaxial or biaxial extruder directly or after preliminarily mixing in a blender or mixer; (2) a melt mixing method for compounding the silica-based inorganic particles and the polyester in a conventional uniaxial or biaxial vented extruder directly or after preliminarily mixing in a blender or mixer; and (3) a method for adding the silica-based inorganic particles in a reaction step of the polyester polymerization line. The third method in which the silica-based inorganic particles are added in the polymerization step of the polyester is preferable because of high dispersibility of the particles. The method for adding large amounts of silica-based inorganic particles in the polymerization step of the polyester, however, causes a rapid increase in melt viscosity of the reaction system, namely, increasing melt viscosity. Thus, the degree of polymerization may not be increased to a satisfactory level in practice.

One preferred method for solving this problem is addition of other particles together with the silica-based inorganic particles. More preferably, the silica-based inorganic particles are mixed with the other particles and then the mixture is added to the polyester. Here, a method of mixing is simply adding the other particles to the silica-based inorganic particles before the silica-based inorganic particles are added to the reaction system. The mixture may be heat-treated. The addition of the other particles can suppress increasing melt viscosity of the polymer melt when the silica-based inorganic particles are added.

Preferred other particles are basic particles. Examples of the basic particles include particles of alumina, zirconia, barium sulfate, calcium carbonate, and spinel. The amount of the basic particles to be added is preferably in the range of 0.1 to 10 percent by weight, more preferably in the range of 0.5 to 5 percent by weight, and most preferably 1.0 to 3 percent by weight.

It is preferable to suppress increasing melt viscosity during polymerization that the silica-based inorganic particles of the present invention be treated with at least one selected from the group consisting of aluminum compounds, compounds of transition metals belonging to the fourth period in the periodic table, lithium compounds, sodium compounds, potassium compounds, magnesium compounds, calcium compounds, barium compounds, boron compounds, phosphorus compounds, and silane coupling agents. In this treatment, the above compound may be mixed with the silica-based inorganic particles before adding the polymer. Moreover, the mixture may be heated. Alternatively, the treatment may be performed in slurry of the silica-based inorganic particles dispersed in ethylene glycol. The above compounds adhere to the surfaces of the silica-based inorganic particles during such a treatment. The content of these compounds is preferably in the range of 0.1 to 10 percent by weight, more preferably in the range of 0.5 to 5 percent by weight, and most preferably in the range of 1.0 to 3 percent by weight.

Examples of aluminum compounds, compounds of transition metals belonging to the fourth period in the periodic table, lithium compounds, sodium compounds, potassium compounds, magnesium compounds, calcium compounds, barium compounds, and boron compounds are sulfates, nitrates, carbonates, chlorides, and hydroxides.

Among these above-mentioned metal compounds, the aluminum compounds and the compounds of transition metals belonging to the fourth period in the periodic table are preferable. Preferable compounds of transition metals belonging to the fourth period in the periodic table are Mn compounds, Co compounds, and Fe compounds. Preferable aluminum compounds are aluminum sulfate, aluminum nitrate, aluminum carbonate, aluminum chloride, aluminum acetate, aluminum hydroxide, aluminum oxide hydroxide, aluminum chloride hydroxide, aluminum silicate, and aluminum borate. Among these, aluminum acetate and aluminum chloride are more preferable.

Examples of the phosphorus compounds are phosphoric acid, phosphorous acid, trimethylphosphoric acid, triphenylphosphoric acid, dimethylphenyl phosphate, triethyl phosphomonoacetate, phenylsulfonic acid, and carboxyethylmethylphosphinic acid. Preferable phosphorus compounds have many free hydroxyl groups. Examples of such compounds are phosphoric acid, phosphorous acid, and phenylphosphonic acid.

The silane coupling agents used in the present invention include of low molecular weight types to high molecular weight types and monofunctional silane monomers. The treatment with the silane coupling agent means chemical bonding of the silane coupling agent to the silica-based inorganic particles before addition to the polymer. For example, the silica-based inorganic particles are dispersed into ethylene glycol. After the pH of the dispersion is adjusted, the particles are allowed to react with a silane coupling agent at a predetermined temperature. Examples of the silane coupling agents include hexamethyldisilazane, dimethyldimethoxysilane, vinyl silanes, such as vinyltrichlorosilane, epoxy silanes, such as γ-glycidoxypropyltrimethoxysilane, amino silanes, such as N-β-(aminoethyl)-γ-aminopropyltrimethoxysilane, and silicone-type silanes, such as water-soluble organic silicone resins and dimethylpolysiloxanes. Hydrophobic silane coupling agents having high affinity for the polyester are preferable. Hexamethyldisilazane and dimethyldimethoxysilane are more preferable.

It is desirable that the antimony content in the polyester fiber of the present invention is 200 ppm or less. At an antimony content of 200 ppm or less, agglomeration of the particles and a rapid increase in melt viscosity of the polymer which are caused by high surface activity of the particles are prevented in the polycondensation step of the production process of the polyester. Thus, the resulting polyester has high particle dispersion and a high molecular weight. Moreover, a rapid increase in the filter pressure is prevented in the melt-processing step; hence, yarn breakage barely occurs in the spinning step. The antimony content is preferably in the range of 0.1 to 150 ppm, more preferably 5 to 100 ppm, and most preferably 10 to 50 ppm. Antimony content exceeding 200 ppm causes poor dispersion and a rapid increase in melt viscosity in the production process of the polyester. Since the resulting polyester does not have a high molecular weight, the polyester may exhibit poor spinning processability, and decreased mechanical strength in some cases.

The polyester of the present invention can be produced by a conventional method, as described above.

The polyester containing the silica-based inorganic particles is melted, introduced into a spinning pack, and is spun from nozzles. The spun filaments are stretched at a predetermined rate and are wound into packages. The unstretched filaments are stretched using a conventional drawing machine. Alternatively, the spun filaments may be directly stretched by a continuous process without winding, or filaments may be spun at a high spinning rate of 4,000 m/min or more without stretching, in order to achieve desired fiber characteristics.

In a direct spinning and stretching method, for example, filaments are spun at a rate of 1,000 to 5,000 m/min and are stretched and thermally set at a rate of 3,000 to 6,000 m/min.

The cross section of the polyester fiber of the present invention may be a non-circular cross section, for example, may be circular, triangular, ellipsoidal, starry, polygonal, H-shaped, or II-shaped. The polyester fiber of the present invention may be a filament or a staple fiber according to applications.

The polyester fiber of the present invention may be used as woven fabrics, knitted fabrics, and nonwoven fabrics according to the application.

EXAMPLES

The present invention will now be described with reference the following EXAMPLES in further detail. Characteristics in these EXAMPLES have been determined as follows:

A. Intrinsic Viscosity of Polyester

The intrinsic viscosity was measured as an o-chlorophenol solution at 25° C.

B. Hygroscopic Parameter ΔMR of Particles and Fibers Containing the Same.

The moisture absorption rate of particles was determined using 1 g particles and that of the fiber was determined using 1 to 3 g of textile. The moisture absorption rate MR1 was determined using the following equation:

$$\text{Moisture absorption rate (\%)}=\{(\text{weight after moisture absorption}-\text{dry weight})/(\text{dry weight})\}\times 100$$

wherein the weight after moisture absorption was measured after the sample was placed in a thermohygrostat (TABAI ESPEC CORP.) at 20° C. and 65% RH for 24 hours.

Similarly, the moisture absorption rate MR2 was determined from a difference between the weight after moisture absorption at 30° C. and 90% RH for 24 hours and the dry weight.

The hygroscopic parameter ΔMR (%) was calculated from the MR1 and MR2 values as follows:

$$\text{Hygroscopic parameter } \Delta MR = MR2 - MR1$$

C. DEG Content in Polyester

After the polyester was hydrolyzed in hot monoethanolamine, the solution was diluted with 1,6-hexanediol/methanol and was neutralized with terephthalic acid. The DEG content was determined from the area ratio by of the DEG-peak to a reference peak by gas chromatography.

D. Carboxyl End Group Content in Polyester

The polyester was dissolved into o-cresol and the carboxyl end group content was determined by potentiometric titration using an aqueous sodium hydroxide solution.

E. Average Diameter and Diameter Distribution of Particles

The average diameter and the diameter distribution of particles were determined using a particle size analyzer LA-700 made by HORIBA, Ltd. The ratio d90/d10 means the ratio of a 90%-volume-accumulated particle diameter to a 10%-volume-accumulated particle diameter.

F. Specific Surface Area of Particles

The specific surface area of the particles was determined by a gas adsorption method (BET method using gaseous $N_2$).

G. Micropore Volume of Particles

The micropore volume of the particles was determined by mercury intrusion porosimetry.

H. Determination of Silanol Groups of Particles

The silica-based inorganic particles were dried at 120° C. under a reduced pressure of 0.1 KPa or less for 24 hours and were allowed to react with $LiAlH_4$ in dioxane. The silanol groups of the particles were determined by the amount of the evolved hydrogen.

I. Aspect Ratio of Particles

The diameter or length in the major axis and the diameter or length in the minor axis of 100 silica-based inorganic particles were measured by electron microscopy (the magnification, for example, ×1,500) was appropriately determined according to the particle size and the ratio of the length in the major axis to that in the minor axis was calculated for each particle. The aspect ratio of the particles was determined by the average of the calculated aspect ratios.

J. Strength and Elongation

A fiber with an effective length of 20 cm was stretched at a rate of 10 cm/min using a tensilometer (made by Toyo Waldwin Co., Ltd.) and the strength and elongation were determined from the resulting stress-strain curve.

K. Determination of Antimony in Polyester Composition

Antimony was determined from the peak intensity assigned to antimony by fluorescent X-ray spectrometry with reference to a calibration curve obtained from standard samples.

L. Determination of Metals other than Antimony and Particles Incorporated by Treatment Metals other than antimony and particles adhering to the surfaces of the silica-based inorganic particles were determined with a fluorescent X-ray spectrometer (FLX) made by Rigaku Corporation.

M. Separation of Silica-based Inorganic Particles from Polyester

Yarn (10 g) containing silica-based inorganic particles was dissolved into 100 ml of o-chlorophenol at 100° C. After centrifugation at 16,000 rpm (32,000 G) for 1 hour using a high-rate centrifuge made by Hitachi Koki Co., Ltd., the supernatant was removed. Next, 50 ml of o-chlorophenol was added to the residue and the dispersion was thoroughly stirred so that the particles were homogeneously dispersed in the solvent, and the supernatant was removed by centrifugation. This procedure was repeated three times. The residue was washed three times with each 30 ml of acetone. The precipitate was dried in vacua at 60° C. for 1 hour. The silica-based inorganic particles were thereby isolated.

N. Determination of Polyester Adhering to Isolated Particles

The above silica-based inorganic particles (8 to 10 mg) isolated from the polyester fiber were heated from room temperature to 500° C. at a rate of 10° C./min in an oxygen atmosphere using a differential thermal and thermal gravimetric analyzer TG-DTA 2000S made by MAC Science Co., Ltd., to obtain a thermogravimetric curve. The polyester adhering to the silica-based inorganic particles was determined from a reduction in weight which was calculated using the thermogravimetric curve according to Japanese Industrial Standard (JIS) K 7120.

O. Evaluation of Increasing Melt Viscosity During Polymerization

Particle-free polyester was polymerized, and the time when the intrinsic viscosity [η] determined by starring torque reached 0.66 dl/g was measured as a standard. Similarly, polyesters containing particles were polymerized and the time when the intrinsic viscosity of each polyester reached the above value was measured. The ratio of the taking time of each sample to the standard taking time was used as a measure of increasing melt viscosity in the polymerization process as follows:

NG (unallowable due to remarkable gelation): a ratio less than ½
A (average): a ratio of ½ to ⅔
S (satisfactory): a ratio of ¾ to ¾
SS (superior): a ratio exceeding ¾.

Example 1

Wet-process silica-based inorganic particles having an average diameter of 0.5 μm, a micropore volume of 1.2 ml/g, a S/V ratio of 600, and a hygroscopic parameter ΔMR of 40.6% were used. Polyester was prepared as follows. Methanol was removed by ester exchange from a mixture of 194 parts by weight of dimethyl terephthalate, 124 parts by weight of ethylene glycol, and 0.05 parts by weight of magnesium acetate. Next, ethylene glycol containing 0.08 parts by weight of trimethyl phosphate was added thereto. Furthermore, ethylene glycol slurry containing 8 parts by weight of the silica-based inorganic particles and 0.1 parts by weight of antimony trioxide were added thereto. The mixture was gradually evacuated to 0.1 kPa or less while being heated to 290° C., and was maintained at the temperature for 3.5 hours to obtain polyester chips. The polyester chips contained 7.0 percent by weight silica-based inorganic particles and had a ΔMR value of 2.8%.

The chips were melted at 290° C. and the melt was extruded at a extrusion rate of 25 g/min through a spinneret and the filament was wound up at a spinning rate of 1,000 m/min to form an unstretched filament. This unstretched filament was stretched to 3.0 times at a stretching temperature of 90° C., a thermosetting temperature of 130° C., and a stretching rate of 800 m/min to form a 107tex-24f stretched fiber. As mechanical properties, the strength was 4.0 cN/dtex and the elongation was 42.0%. The stretched fiber was knitted to form a tube. The tube was subjected to a moist heat treatment. The hygroscopic parameter ΔMR of the knit was 2.8%. Thus, the fiber exhibited satisfactory hygroscopicity.

Examples 2 and 3 and Comparative Example 1 and 2

Polyesters and fibers were prepared as in EXAMPLE 1 except that the content of the silica-based inorganic particles was changed. The sample of COMPARATIVE EXAMPLE 1 did not exhibit satisfactory hygroscopicity due to a significantly small content of the silica-based inorganic particles. The filament of COMPARATIVE EXAMPLE 2 broke due to an excess amount of the particles and no fiber was obtained.

Example 4 and Comparative Example 3

Polyesters and fibers were prepared as in EXAMPLE 1 except that the micropore volume of the silica-based inorganic particles was changed. The sample of COMPARATIVE EXAMPLE 3 did not exhibit satisfactory hygroscopicity due to a significantly small volume of micropores.

Examples 5 and 6 and Comparative Example 4 and 5

Polyesters and fibers were prepared as in EXAMPLE 1 except that the S/V ratio was changed. The samples of COMPARATIVE EXAMPLES 4 and 5, outside of the present invention, did not exhibit satisfactory hygroscopicity.

Examples 7 and 8 and Comparative Example 6 and 7

Polyesters and fibers were prepared as in EXAMPLE 1 except that the average particle diameter of the silica-based inorganic particles was changed. The sample of COMPARATIVE EXAMPLE 6 exhibited agglomeration of particles due to poor dispersion which was caused by a significantly small average diameter of the silica-based inorganic particles. The filament of COMPARATIVE EXAMPLE 7 broke due to a significantly large particle diameter and no fiber was obtained.

Example 9

Polyester and a fiber were prepared as in EXAMPLE 1 except that the ΔMR value of the particles was changed. The hygroscopic parameter ΔMR of the fiber was 1.1%, resulting in satisfactory hygroscopic characteristics.

Examples 10 and 11

Polyesters and fibers were prepared as in EXAMPLE 1 except that the DEG content was changed. The ΔMR values of EXAMPLES 10 and 11 were 2.3% and 1.2%, respectively, and were satisfactory.

Examples 12, 13, and 14

Polyesters and fibers were prepared as in EXAMPLE 1 except that the COOH content was changed. The ΔMR values of EXAMPLES 12, 13, and 14 were 3.0%, 2.2%, and 3.5%, respectively, and were satisfactory.

Examples 15 and 16

Polyesters and fibers were prepared as in EXAMPLE 1 except that the amount of PET adhering to the silica-based inorganic particles was changed. The hygroscopic parameters ΔMR of EXAMPLES 15 and 16 were 2.2% and 1.1%, respectively, and were satisfactory.

Examples 17 and 18

Polyesters and fibers were prepared as in EXAMPLE 1 except that the content of coarse particles (having diameters of 4 μm or more) was changed. The ΔMR value of these samples was 2.8%, respectively, and was satisfactory.

Examples 19 and 20

Polyesters and fibers were prepared as in EXAMPLE 1 except that the fibers were a bimetal fiber in EXAMPLE 19 and a core-sheath bicomponent fiber in EXAMPLE 20. The hygroscopic parameter ΔMR of these fibers was 2.6% and was satisfactory.

Examples 21 and 22

Polyesters and fibers were prepared as in EXAMPLE 1 except that the d90/d10 ratio was changed. The hygroscopic parameter ΔMR of these fibers was 2.8% and was satisfactory.

Examples 23 and 24

Polyesters and fibers were prepared as in EXAMPLE 1 except that the aspect ratio of the particles was changed. The hygroscopic parameter ΔMR of these fibers was 2.8% and was satisfactory.

Example 25

Polyester and a fiber were prepared as in EXAMPLE 1 except that alumina particles were added to ethylene glycol slurry in an amount of 2 percent by weight with respect to the polyester and the slurry was compounded to the polyester. The addition of the alumina particles suppressed increasing melt viscosity during polymerization, and particles were well dispersed in the resulting polyester and fiber.

Example 26

Polyester and a fiber were prepared as in EXAMPLE 1 except that barium sulfate particles were added to ethylene glycol slurry in an amount of 2 percent by weight with respect to the polyester and the slurry was compounded to the polyester. The addition of the barium sulfate particles suppressed increasing melt viscosity during polymerization, and particles were well dispersed in the resulting polyester and fiber.

Example 27

A polyester and a fiber were prepared as in EXAMPLE 1 except that aluminum chloride was added to ethylene glycol slurry in an amount of 1.5 percent by weight with respect to the polyester, and the slurry was heated to 60° C. and was compounded to the polyester. The treatment with aluminum chloride suppressed increasing melt viscosity during polymerization, and particles were well dispersed in the resulting polyester and fiber.

Example 28

Polyester and a fiber were prepared as in EXAMPLE 1 except that aluminum silicate particles were added to ethylene glycol slurry in an amount of 2 percent by weight with respect to the polyester and the mixture was compounded to the polyester. The addition of the aluminum silicate particles suppressed increasing melt viscosity during polymerization, and particles were well dispersed in the resulting polyester and fiber.

Example 29

A polyester and a fiber were prepared as in EXAMPLE 1 except that manganese acetate was added to ethylene glycol slurry in an amount of 1.5 percent by weight with respect to the polyester, and the slurry was heated to 60° C. and was compounded to the polyester. The treatment with aluminum chloride suppressed increasing melt viscosity during polymerization, and particles were well dispersed in the resulting polyester and fiber.

Example 30

A polyester and a fiber were prepared as in EXAMPLE 1 except that phosphoric acid was added to ethylene glycol slurry in an amount of 1.0 percent by weight with respect to the polyester, and the slurry was heated to 60° C. and was compounded to the polyester. The treatment with phosphoric acid suppressed increasing melt viscosity during polymerization, and particles were well dispersed in the resulting polyester and fiber.

Example 31

Polyester and a fiber were prepared as in EXAMPLE 1 except that the silica-based inorganic particles were treated with 2 percent by weight of hexamethyldisilazane and then were compounded to the polyester. The treatment with hexamethyldisilazane suppressed increasing melt viscosity during polymerization, and particles were well dispersed in the resulting polyester and fiber:

Example 32

Polyester and a fiber were prepared as in EXAMPLE 1 except that the antimony content was 30 ppm. The reduction in the antimony content caused a decrease in polymerization rate and suppressed increasing melt viscosity during polymerization.

TABLE 1

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Content (wt %) | 7 | 20 | 3 | 7 | 7 | 7 | 7 | 7 | 7 | 7 | 7 |
| V (ml/g) | 1.2 | 1.2 | 1.2 | 0.5 | 1.2 | 1.2 | 1.2 | 1.2 | 1.2 | 1.2 | 1.2 |
| S/V ($m^2$/ml) | 600 | 600 | 600 | 600 | 1500 | 100 | 600 | 600 | 600 | 600 | 600 |
| Average Diameter ($\mu$m) | 0.5 | 0.5 | 0.5 | 0.5 | 0.5 | 0.5 | 10.0 | 0.01 | 0.5 | 0.5 | 0.5 |
| ΔMR of Particles (%) | 40.6 | 40.6 | 40.2 | 40.2 | 38.2 | 15.0 | 40.6 | 40.6 | 16.0 | 40.6 | 40.6 |
| DEG (wt %) | 0.8 | 0.8 | 0.8 | 0.8 | 0.8 | 0.8 | 0.8 | 0.8 | 0.8 | 1.5 | 2.5 |
| COOH End (eq/t) | 25 | 25 | 25 | 25 | 25 | 25 | 25 | 25 | 25 | 25 | 25 |
| Amount of Adhered PET (g) | 0.08 | 0.08 | 0.08 | 0.08 | 0.08 | 0.08 | 0.08 | 0.08 | 0.08 | 0.08 | 0.08 |
| Coarse Particle Content (%)* | 3.5 | 3.5 | 3.5 | 3.5 | 3.5 | 3.5 | 3.5 | 3.5 | 3.5 | 3.5 | 3.5 |
| d90/d10 | 1.5 | 1.5 | 1.5 | 1.5 | 1.5 | 1.5 | 1.5 | 1.5 | 1.5 | 1.5 | 1.5 |
| Aspect Ratio | 1.2 | 1.2 | 1.2 | 1.2 | 1.2 | 1.2 | 1.2 | 1.2 | 1.2 | 1.2 | 1.2 |
| Sb Content (ppm) | 150 | 150 | 150 | 150 | 150 | 150 | 150 | 150 | 150 | 150 | 150 |
| Mechanical Properties of Fiber | | | | | | | | | | | |
| Strength (cN/dtex) | 4.0 | 3.1 | 4.3 | 4.1 | 4.0 | 3.9 | 3.5 | 4.1 | 3.9 | 4.0 | 3.8 |
| Elongation (%) | 42.0 | 34.0 | 42.0 | 41.0 | 42.0 | 41.0 | 38.0 | 43.0 | 41.0 | 40.0 | 43.0 |
| ΔMR (%) | 2.8 | 6.5 | 1.2 | 2.8 | 2.6 | 1.1 | 2.8 | 2.8 | 1.1 | 2.3 | 1.2 |
| Increasing melt viscosity | A | A | S | A | A | A | A | A | A | A | A |

*In Tables 1 to 5, particles of 4 $\mu$m or more are defined as coarse particles.

TABLE 2

| | Example 12 | Example 13 | Example 14 | Example 15 | Example 16 | Example 17 | Example 18 | Example 19 | Example 20 |
|---|---|---|---|---|---|---|---|---|---|
| Content(percent by weight) | 7 | 7 | 7 | 7 | 7 | 7 | 7 | 7 | 17 |
| V (ml/g) | 1.2 | 1.2 | 1.2 | 1.2 | 1.2 | 1.2 | 1.2 | 1.2 | 1.2 |
| S/V ($m^2$/ml) | 600 | 600 | 600 | 600 | 600 | 600 | 600 | 600 | 600 |
| Average Diameter ($\mu$m) | 0.5 | 0.5 | 0.5 | 0.5 | 0.5 | 0.5 | 0.5 | 0.5 | 0.5 |
| ΔMR of Particles (%) | 40.6 | 40.6 | 40.6 | 40.6 | 40,6 | 40.6 | 40.6 | 40.6 | 40.6 |
| DEG (percent by weight) | 0.8 | 0.8 | 0.8 | 0.8 | 0.8 | 0.8 | 0.8 | 0.8 | 0.8 |
| COOH End (equivalent/ton) | 40 | 5 | 60 | 25 | 25 | 25 | 25 | 25 | 25 |
| Amount of Adhered PET (g) | 0.08 | 0.08 | 0.08 | 0.25 | 0.5 | 0.08 | 0.08 | 0.08 | 0.08 |
| Coarse Particle Content (%) | 3.5 | 3.5 | 3.5 | 3.5 | 3.5 | 4.8 | 6.0 | 3.5 | 3.5 |
| d90/d10 | 1.5 | 1.5 | 1.5 | 1.5 | 1.5 | 1.5 | 1.5 | 1.5 | 1.5 |
| Aspect Ratio | 1.2 | 1.2 | 1.2 | 1.2 | 1.2 | 1.2 | 1.2 | 1.2 | 1.2 |
| Sb Content (ppm) | 150 | 150 | 150 | 150 | 150 | 150 | 150 | 150 | 150 |
| Mechanical Properties of Fiber | | | | | | | | | |
| Strength (cN/dtex) | 3.8 | 4.0 | 3.2 | 4.0 | 3.9 | 3.8 | 2.5 | 4.0 | 4.5 |
| Elongation (%) | 41.0 | 42.0 | 36.0 | 42.0 | 40.0 | 39.0 | 32.0 | 42.0 | 45.0 |
| ΔMR (%) | 3.0 | 2.2 | 3.5 | 2.2 | 1.1 | 2.8 | 2.8 | 2.6 | 2.6 |
| Increasing melt viscosity | A | A | A | A | A | A | A | A | A |

TABLE 3

| | Example 21 | Example 22 | Example 23 | Example 24 | Example 25 | Example 26 | Example 27 | Example 28 | Example 29 |
|---|---|---|---|---|---|---|---|---|---|
| Content (percent by weight) | 7 | 7 | 7 | 7 | 7 | 7 | 7 | 7 | 7 |
| V (ml/g) | 1.2 | 1.2 | 1.2 | 1.2 | 1.2 | 1.2 | 1.2 | 1.2 | 1.2 |
| S/V ($m^2$/ml) | 600 | 600 | 600 | 600 | 600 | 600 | 600 | 600 | 600 |
| Average Diameter ($\mu$m) | 0.5 | 0.5 | 0.5 | 0.5 | 0.5 | 0.5 | 0.5 | 0.5 | 0.5 |
| ΔMR of Particles (%) | 40.6 | 40.6 | 40.6 | 40.6 | 40.6 | 40.6 | 40.6 | 40.6 | 40.6 |
| DEG (percent by weight) | 0.8 | 0.8 | 0.8 | 0.8 | 0.8 | 0.8 | 0.8 | 0.8 | 0.8 |
| COOH End (equivalent/ton) | 25 | 25 | 25 | 25 | 25 | 25 | 40 | 25 | 25 |
| Amount of Adhered PET (g) | 0.08 | 0.08 | 0.08 | 0.08 | 0.08 | 0.08 | 0.08 | 0.08 | 0.08 |
| Coarse Particle Content (%) | 3.5 | 3.5 | 3.5 | 3.5 | 3.5 | 3.5 | 3.5 | 3.5 | 3.5 |
| d90/d10 | 2.0 | 2.5 | 1.5 | 1.5 | 1.5 | 1.5 | 1.5 | 1.5 | 1.5 |
| Aspect Ratio | 1.2 | 1.2 | 1.4 | 1.27 | 1.2 | 1.2 | 1.2 | 1.2 | 1.2 |
| Type of Particles or Compound | — | — | — | — | Alumina | Barium Sulfate | Aluminum Chloride | Silica Alumina | Phosphoric Acid |
| Content of Particle or Metal Compound (%) | — | — | — | — | 2.0 | 2.0 | 1.5 | 2.0 | 1.0 |

TABLE 3-continued

| | Example 21 | Example 22 | Example 23 | Example 24 | Example 25 | Example 26 | Example 27 | Example 28 | Example 29 |
|---|---|---|---|---|---|---|---|---|---|
| Sb Content (ppm) | 150 | 150 | 150 | 150 | 150 | 150 | 150 | 150 | 150 |
| Mechanical Properties of Fiber | | | | | | | | | |
| Strength (cN/dtex) | 3.9 | 2.4 | 3.9 | 2.2 | 4.0 | 4.0 | 3.9 | 4.0 | 4.0 |
| Elongation (%) | 40.0 | 31.0 | 39.5 | 33.0 | 41.0 | 41.0 | 40.0 | 41.0 | 42.0 |
| ΔMR (%) | 2.8 | 2.8 | 2.8 | 2.8 | 2.8 | 2.3 | 3.0 | 2.0 | 2.8 |
| Increasing melt viscosity | A | A | A | A | SS | S | SS | S | SS |

TABLE 4

| | Example 30 | Example 31 | Example 32 |
|---|---|---|---|
| Content (percent by weight) | 7 | 7 | 7 |
| V (ml/g) | 1.2 | 1.2 | 1.2 |
| S/V ($m^2$/ml) | 600 | 600 | 600 |
| Average Diameter (μm) | 0.5 | 0.5 | 0.5 |
| ΔMR of Particles (%) | 40.6 | 40.6 | 40.6 |
| DEG (percent by weight) | 1.0 | 0.8 | 0.8 |
| COOH End (equivalent/ton) | 25 | 25 | 25 |
| Amount of Adhered PET (g) | 0.08 | 0.08 | 0.08 |
| Coarse Particle Content (%) | 3.5 | 3.5 | 3.5 |
| d90/d10 | 1.5 | 1.5 | 1.5 |
| Aspect Ratio | 1.2 | 1.2 | 1.2 |
| Type of Particles or Compound | Phosphoric acid | hexamethyl-disilazane | — |

TABLE 4-continued

| | Example 30 | Example 31 | Example 32 |
|---|---|---|---|
| Content of Particle or Metal Compound (%) | 1.0 | — | 1.2 |
| Sb Content (ppm) | 150 | 150 | 30 |
| Mechanical Properties of Fiber | | | |
| Strength (cN/dtex) | 4.0 | 4.3 | 4.0 |
| Elongation (%) | 42.0 | 40.0 | 44.0 |
| ΔMR (%) | 2.8 | 2.4 | 2.8 |
| Increasing melt viscosity | SS | SS | SS |

TABLE 5

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Content (percent by weight) | 0.5 | 22 | 7 | 7 | 7 | 7 | 7 |
| V (ml/g) | 1.2 | 1.2 | 0.2 | 1.2 | 1.2 | 1.2 | 1.2 |
| S/V ($m^2$/ml) | 600 | 600 | 600 | 50 | 1800 | 600 | 600 |
| Average Diameter (μm) | 0.5 | 0.5 | 0.5 | 0.5 | 7.0 | 0.005 | 12 |
| ΔMR of Particles (%) | 40.6 | 40.6 | 6.5 | 6.0 | 9.5 | 40.6 | 40.6 |
| DEG (percent by weight) | 0.8 | 0.8 | 0.8 | 0.8 | 0.8 | 0.8 | 0.8 |
| COOH End (equivalent/ton) | 25 | 25 | 25 | 25 | 25 | 25 | 25 |
| Amount of Adhered PET (g) | 0.08 | 0.08 | 0.08 | 0.08 | 0.08 | 0.08 | 0.08 |
| Coarse Particle Content (%) | 3.5 | 3.5 | 3.5 | 3.5 | 3.5 | 3.5 | 3.5 |
| d90/d10 | 1.5 | 1.5 | 1.5 | 1.5 | 1.5 | 1.5 | 1.5 |
| Aspect Ratio | 1.2 | 1.2 | 1.2 | 1.2 | 1.2 | 1.2 | 1.2 |
| Sb Content (ppm) | 150 | 150 | 150 | 150 | 150 | 150 | 150 |
| Mechanical Properties of Fiber | | | | | | | |
| Strength (cN/dtex) | 4.2 | — | 4.0 | 4.0 | 4.0 | — | — |
| Elongation (%) | 44.0 | — | 41.0 | 42.0 | 42.0 | — | — |
| ΔMR (%) | 0.2 | 8.0 | 0.5 | 0.4 | 0.7 | 2.8 | 2.8 |
| Increasing melt viscosity | S | NG | A | A | A | NG | S |

What is claimed is:

1. A polyester fiber comprising a polyester having a diethylene glycol content of 2 percent by weight or less; and a carboxyl end group content in the range of 10 to 50 equivalent/ton, the polyester fiber having a hygroscopic parameter ΔMR of 1% or more and containing 1 to 20 percent by weight of silica-based inorganic particles, wherein the silica-based inorganic particles satisfy the following conditions (A) to (C):

(A) the micropore volume "V" is 0.4 ml/g or more, and the following relationship is satisfied:

$$100 \leqq S/V < 1{,}500$$

wherein S means the specific surface area S ($m^2/g$) of the inorganic particles;

(B) the average particle diameter D is in the range of 0.01 to 10 $\mu$m; and (C) the hygroscopic parameter ΔMR is 7% or more.

2. A polyester fiber according to claim 1, wherein the amount of the polyester adhering to the silica-based inorganic particles in the polyester fiber is 0.3 g or less per one gram of silica-based inorganic particles.

3. A polyester fiber according to claim 1, wherein the fiber is moist heat treated.

4. A polyester fiber according to claim 1, wherein the content of particles of 4 $\mu$m or more in the silica-based inorganic particles is 5% or less.

5. A polyester fiber according to claim 1, wherein the silica-based inorganic particles are prepared by a wet process.

6. A polyester fiber according to claim 1, wherein the fiber is a conjugated fiber.

7. A polyester fiber according to claim 6, wherein the conjugated fiber is a core-sheath bicomponent fiber.

8. A polyester fiber according to claim 1, wherein the ratio d90/d10 representing the particle size distribution of the silica-based inorganic particle is 2.0 or less.

9. A polyester fiber according to claim 1, wherein the aspect ratio of the silica-based inorganic articles is in the range of 1.0 to 1.5.

10. A polyester fiber according to claim 1 used for clothes.

11. A polyester fiber according to claim 1, wherein 80% or more of the polyester constituting the polyester fiber comprises alkylene terephthalate repeating units.

12. A polyester fiber according to claim 1, further comprising second particles other than the silica-based inorganic particles.

13. A polyester fiber according to claim 12, wherein the second particles are basic particles.

14. A polyester fiber according to claim 13, wherein the basic particles comprise at least one selected from the group consisting of zirconia, barium sulfate, calcium carbonate, and spinel.

15. A polyester fiber according to claim 1, wherein the silica-based inorganic particles are treated with at least one selected from the group consisting of aluminum compounds, compounds of transition metals belonging to the fourth period in the periodic table, lithium compounds, sodium compounds, potassium compounds, magnesium compounds, calcium compounds, barium compounds, boron compounds, phosphorus compounds, and silane coupling agents.

16. A polyester fiber according to claim 15, wherein the silica-based inorganic particles are treated with one of the aluminum compounds.

17. A polyester fiber according to claim 15, wherein the compound of transition metals belonging to the fourth period in the periodic table is at least one selected from Mn compounds, Co compounds, and Fe compounds.

18. A polyester fiber according to claim 15, wherein the phosphors compound is a least one selected from phosphoric acid, phosphorous acid, and a phenylphosphonic acid derivative.

19. A polyester fiber according to claim 15, wherein the silane coupling agent is at least one selected from hexamethyldisilazane and dimethyldimethoxysilane.

20. A polyester fiber according to claim 1, wherein the polyester fiber has an antimony content in the range of 10 to 200 ppm.

* * * * *